US010615555B1

(12) United States Patent
Altamura

(10) Patent No.: US 10,615,555 B1
(45) Date of Patent: Apr. 7, 2020

(54) CENTRAL SHAFT POWER CONNECTOR FOR LIGHTED ORNAMENTS

(71) Applicant: Seasonal Specialties, LLC, Eden Prairie, MN (US)

(72) Inventor: Steven J. Altamura, Scarsdale, NY (US)

(73) Assignee: Seasonal Specialties, LLC, Eden Prairie, MN (US)

( * ) Notice: Subject to any disclaimer, the term of this patent is extended or adjusted under 35 U.S.C. 154(b) by 0 days.

(21) Appl. No.: 16/449,944

(22) Filed: Jun. 24, 2019

Related U.S. Application Data

(63) Continuation-in-part of application No. 15/968,064, filed on May 1, 2018, now Pat. No. 10,333,252.

(60) Provisional application No. 62/500,054, filed on May 2, 2017.

(51) Int. Cl.

| | |
|---|---|
| ***H01R 13/631*** | (2006.01) |
| ***H01R 33/06*** | (2006.01) |
| ***H01R 43/26*** | (2006.01) |
| ***F21V 21/12*** | (2006.01) |
| ***F21V 23/06*** | (2006.01) |
| ***H01R 33/94*** | (2006.01) |
| *F21W 121/04* | (2006.01) |
| *A47G 33/08* | (2006.01) |
| *H01R 13/645* | (2006.01) |
| *F21W 131/30* | (2006.01) |
| *H01R 24/20* | (2011.01) |

(52) U.S. Cl.
CPC ..... *H01R 33/06* (2013.01); *F21V 21/12* (2013.01); *F21V 23/06* (2013.01); *H01R 13/631* (2013.01); *H01R 33/94* (2013.01); *H01R 43/26* (2013.01); *A47G 2033/0827* (2013.01); *F21W 2121/04* (2013.01); *F21W 2131/30* (2013.01); *H01R 13/6456* (2013.01); *H01R 24/20* (2013.01)

(58) Field of Classification Search
CPC .. H01R 13/631; H01R 13/6456; H01R 24/20; A47G 33/06; A47G 2033/0827; F21W 2121/04; F21W 2131/30
USPC ..... 439/374, 680; 362/123
See application file for complete search history.

(56) References Cited

U.S. PATENT DOCUMENTS

| | | | |
|---|---|---|---|
| 4,275,374 | A | 6/1981 | Chaucer |
| 5,281,158 | A | 1/1994 | Lin |
| 6,951,405 | B2 | 10/2005 | Yao |
| 8,936,379 | B1 | 1/2015 | Chen |
| 9,044,056 | B2 | 6/2015 | Chen |
| 9,222,656 | B2 | 12/2015 | Chen |

(Continued)

FOREIGN PATENT DOCUMENTS

| | | |
|---|---|---|
| WO | 2013091920 | 6/2013 |

*Primary Examiner* — Abdullah A Riyami
*Assistant Examiner* — Justin M Kratt
(74) *Attorney, Agent, or Firm* — Hamre, Schumann, Mueller & Larson, P.C.

(57) ABSTRACT

A central shaft power connector for lighted ornaments is disclosed. A central support pole, such as for a Christmas tree is made in multiple parts joinable with an electrical and mechanical connector which joins the pole parts and simultaneously connects power or other circuits from one part to the other. The connector has two engaging sections and an outrigger platform which locates a connector off to the side of the poles but in alignment. Final alignment is obtained by a key and keyway in the connector parts. The connector is friction fit into a slot on each section so that the connector can be removed and replaced.

7 Claims, 10 Drawing Sheets

(56) References Cited

U.S. PATENT DOCUMENTS

| | | | | |
|---|---|---|---|---|
| 9,439,528 | B2 | 9/2016 | Chen | |
| 9,577,376 | B1 | 2/2017 | Tsai | |
| 9,620,896 | B1 | 4/2017 | Dubbaka | |
| 9,671,074 | B2 | 6/2017 | Chen | |
| 9,700,169 | B2 * | 7/2017 | Wong | A47G 33/06 |
| 9,883,566 | B1 | 1/2018 | Chen | |
| 9,883,706 | B2 | 2/2018 | Chen | |
| 9,894,949 | B1 | 2/2018 | Chen | |
| 9,979,126 | B2 | 5/2018 | Takamura | |
| 10,305,237 | B1 | 5/2019 | Li | |
| 10,333,252 | B1 | 6/2019 | Altamura | |
| 2014/0287618 | A1 * | 9/2014 | Chen | A47G 33/06<br>439/527 |
| 2016/0081508 | A1 * | 3/2016 | Wong | A47G 33/06<br>362/123 |

* cited by examiner

CENTRAL SHAFT POWER CONNECTOR FOR LIGHTED ORNAMENTS

INCORPORATION BY REFERENCE

The entire contents of U.S. patent application Ser. No. 15/968,064 filed 1 May 2018 entitled Central Shaft Power Connector for Lighted Ornaments, from which this application claims priority is also incorporated by reference in its entirety into this application.

BACKGROUND OF THE DISCLOSURE

Field of the Disclosure

The present disclosure is directed to a power connector adjunct to a structural pole whose most common use is in connection with tall standing ornamental lighting whose pole is separable to reduce height for shipping, such as a lighted Christmas tree.

Description of the Related Art

Ornamental lighting on poles, such as pre-lit Christmas trees are often too tall to be shipped in a box. In order to reduce their height, it is necessary for their central structural pole to be divided into multiple sections which are later joined. In pre-lit trees (i.e. trees which have their light strings affixed at the factory), there has to be a way to connect the various light strings after assembly. In the prior art, this was most often accomplished by simple power plugs hanging from branches of the tree. The user had to dig into the tree, which was often very dense, and manually make connections.

A solution which allows the user to automatically connect sections of the tree power both physically and electrically is needed.

A method of manufacture is also disclosed.

The present disclosure in various embodiments overcomes these problems.

BRIEF SUMMARY

The disclosure encompasses many embodiments. One such embodiment is detailed below in summary fashion. Please understand that this summary does not encompass the entire disclosure but is provided to assist the reader in reviewing the entire disclosure and claims which also constitute part of the disclosure.

There is disclosed a central pole/staff which is composed of at least two parts, one of which is received partially within the other to create a contiguous pole along a central axis. The pole may be made of two segments, a first and second segment, each segment being connected to a two-part joint having first and second portions respectively.

The two portions fit into each other and fit into the pole segments. The portions form an intermediary joint between pole segments.

The first portion has a central aperture on its lower end and a tubular projection (which may be noncircular) on the upper end sized to be received within the first pole segment. The second portion has an upper central projection sized to be received within the first portion aperture. The second portion also has a lower aperture sized to receive the second pole segment therein.

The first portion includes a first ledge extending generally orthogonally away from the segments and the axis. The first ledge includes a first connector part extending therefrom.

The second portion includes a second ledge extending generally orthogonally away from the segments and the axis. The second ledge includes a second connector part extending therefrom. Said first and second connector parts aligned to electrically engage when said first and second portions are engaged.

In some embodiments, the first connector part includes a first block having a plurality of terminals, and the second connector part includes a recess and terminals for receiving and electrically connecting to said block.

In some embodiments the aperture on said first portion includes a guide keyway slot and the projection on said second portion includes a keyway pin, so that the slot and pin maintain alignment of the block and recess.

In some embodiments, the aperture on the first portion includes a tapered section and wherein the projection on said second portion includes an expanded diameter section at its proximal end, said expanded diameter section and said tapered section being sized to mate with each other.

Note that the terms upper and lower are only relative and may be reversed and are not necessarily according to the force of gravity.

Also disclosed are at least the following: a central pole connector for electrically and mechanically joining an ornamental lighting pole of at least first and second segments, to create a contiguous pole along a central axis having any or all of the following: a connector having first and second portions, each having upper and lower ends; said first portion having a first central aperture on its lower end and a tubular projection at its upper end, said projection being sized to be received within the first pole segment; said second portion has an upper central projection sized to be received within the first portion aperture; said second portion including a lower aperture sized to receive the second pole segment; said first portion includes a first ledge extending generally orthogonally away from the axis; said first ledge including a first slot including a pair of spaced apart arms extending therefrom; said second portion including a second ledge extending generally orthogonally away from said axis; said second ledge including a second slot including a pair of spaced apart arms extending therefrom; an electrical connector sized to be received within said slot of the first and second portion, said connector being aligned to electrically engage when said first and second portions are engaged.

Also disclosed is wherein the slot is of a predetermined width and said electrical connector includes a width greater than said slot and wherein said arms are resilient so that when said connector is inserted into said slot, said connector is snugly received therein.

Also disclosed is wherein the slot is of a predetermined width and said electrical connector includes a width equal to or less than said slot and wherein said arms are resilient so that when said connector is inserted into said slot, said connector fits therein.

Also disclosed is wherein the connector is maintained in the slot by an adhesive.

Also disclosed is wherein the arm further including inwardly projecting lands which thereby constrict the gap at its opening and wherein the arms are resilient so that when the connector is placed within the gap, it is maintained therein by the lands.

Also disclosed is a method of proving electrical power aligning first and second concentric tubes of an ornamental lighting pole comprising: sizing the first tube, having an open end, to receive within at least part of the second tube; providing flanges on both first and second tubes; providing a slot in each flange sized to receive an electrical connector; sizing said slot to be just smaller than a cross section of the electrical connector; aligning the slots to be collinear; and inserting the electrical connector into the slot.

Many other features and combinations are disclosed and claimed.

DETAILED DESCRIPTION

Figure 1:
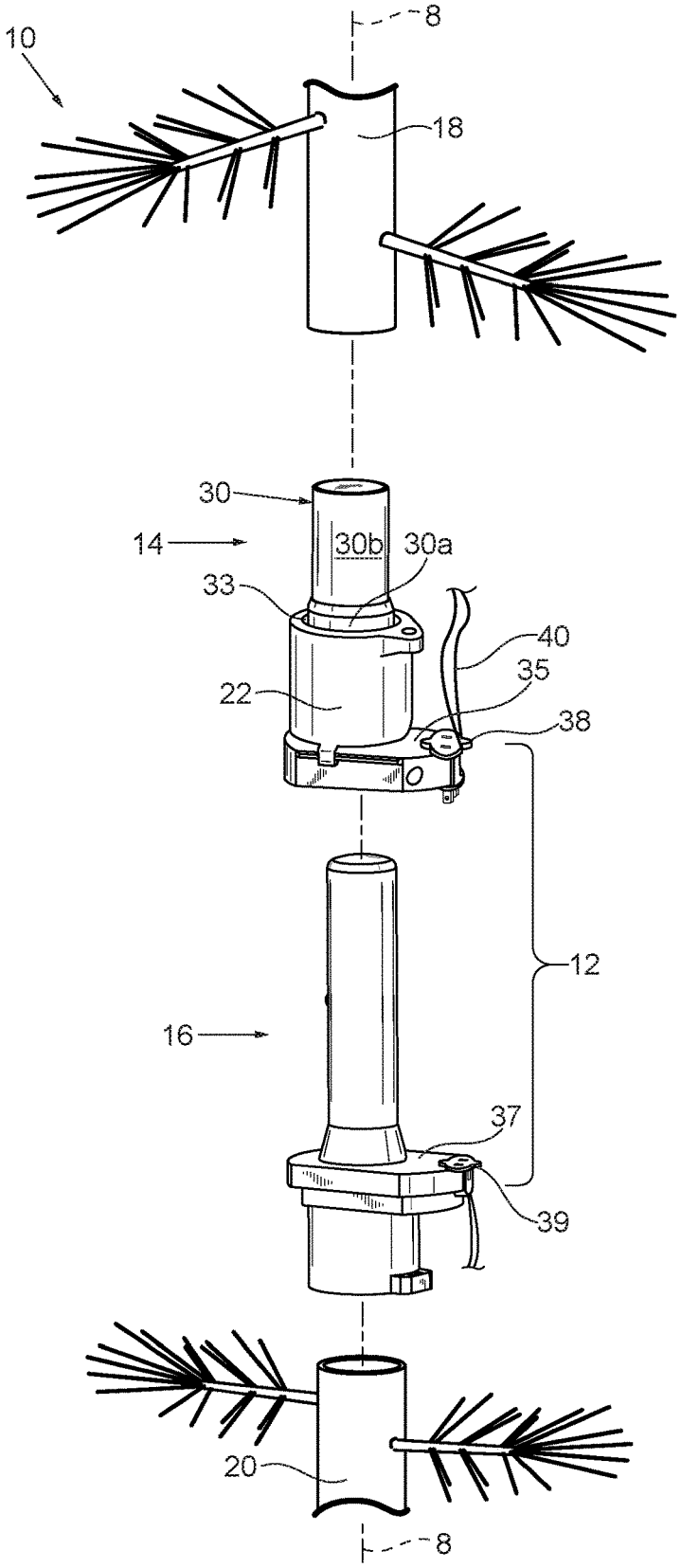
FIG. 1 is a perspective view of a Central Shaft Power Connector for Lighted Ornaments.
Figure 2:
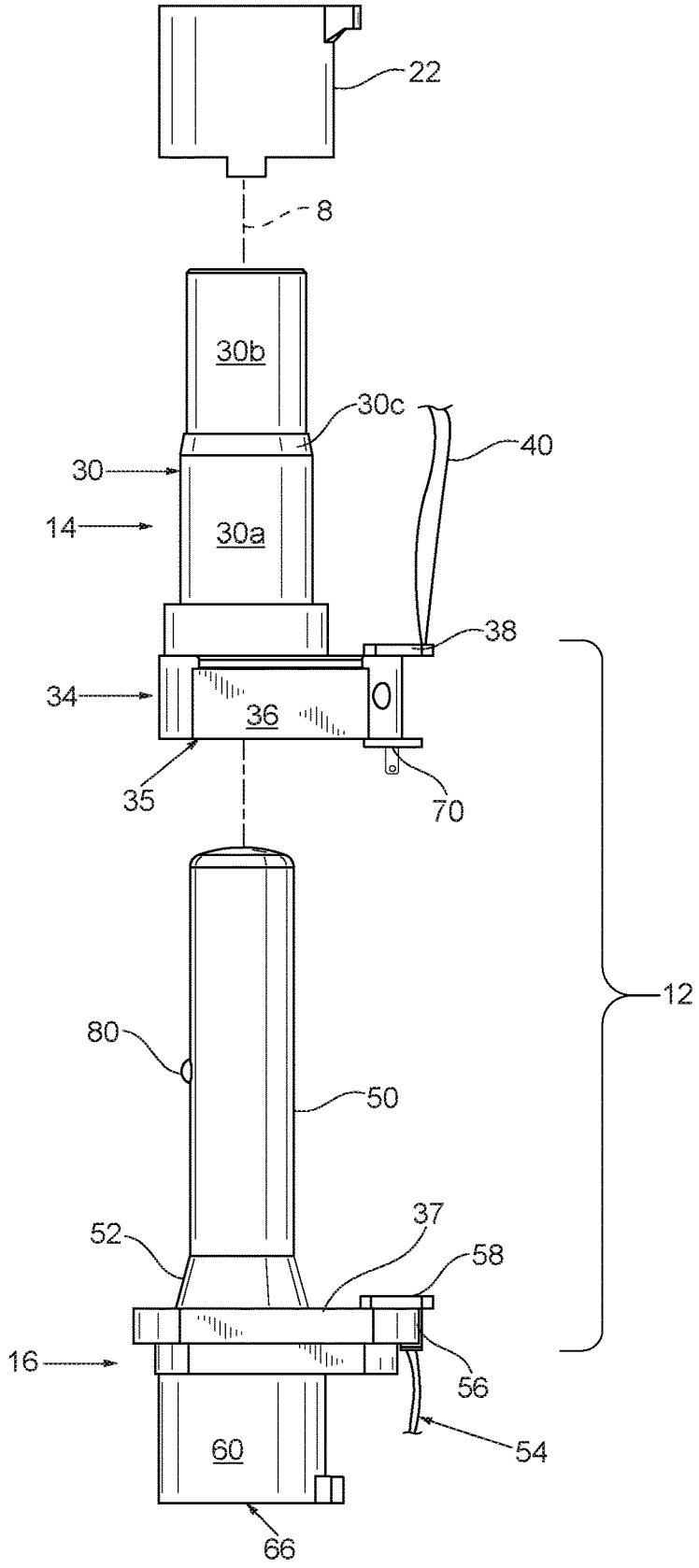
FIG. 2 is an exploded side view of FIG. 1.

FIGS. 1 and 2 illustrate a preferred installation on a Christmas tree pole or other ornamental lighting fixture which requires power being supplied from one portion of the structural pole to the other.

Here is a description of subcomponents: 8 is a central axis along which several parts are aligned; 10 the system of pole and connector; 12 the two parts of the connector; 14 the upper/first portion/part of the connector; 16 the lower/second portion/part of the connector; 18 the upper/first central pole segment with branches showing; 20 the lower/second central pole segment with branches showing; 22 (FIG. 2) collar/sleeve. The retainer collar 22 includes a pair of opposing hooks 23 (only one shown) which have a lip which engages ridge 35 on ledge 36 including a flange extension 37 which receives a connector 39. The collar is used to clamp a further part of the pole to this connector. Element 30 is the upper portion protrusion/projection having two diameters 30*a*/30*b* and tapered section 30*c* therebetween. The projection is sized to be received within pole portion. Collar 22 fits and snaps over section 30*a* and creates a gap between the two diameters which provides a strong connection with the pole segment.

Figure 7:
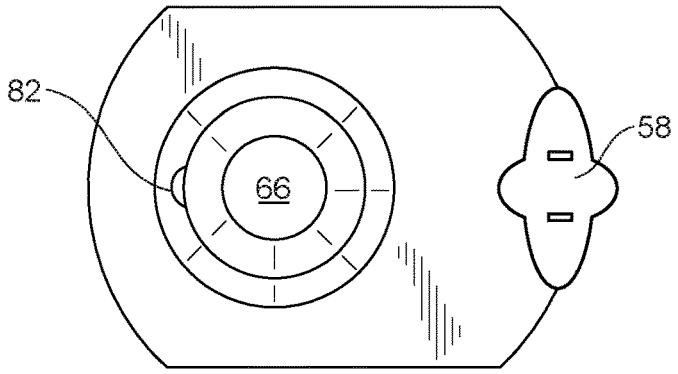
FIG. 7 is a bottom plan view.
Figure 12:
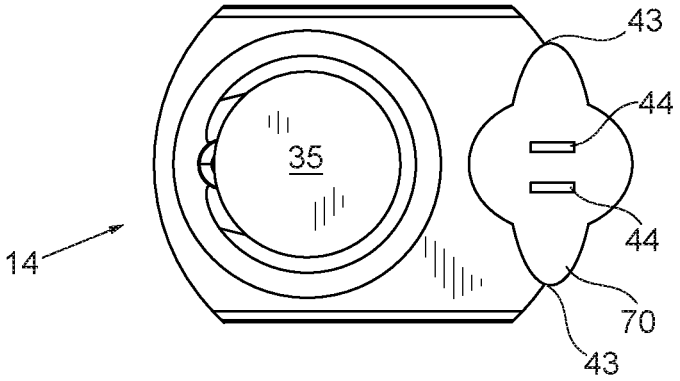
FIG. 12 is a top plan view of FIG. 11.
Figure 13:
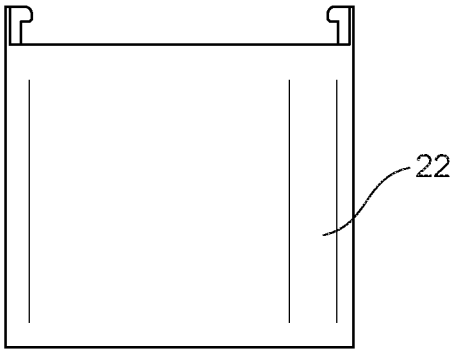
FIG. 13 is a side view of a removable collar/sleeve in FIG. 2.
Figure 14:
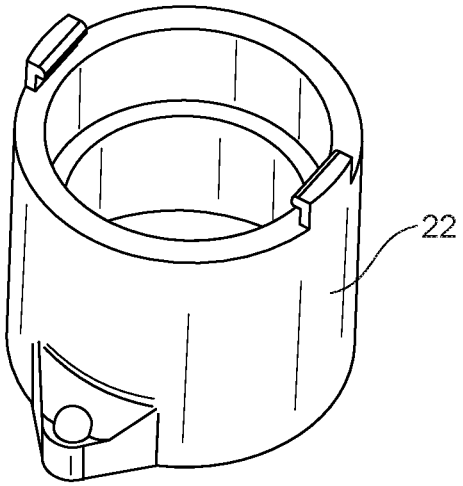
FIG. 14 is a perspective view of the collar.
Figure 15:
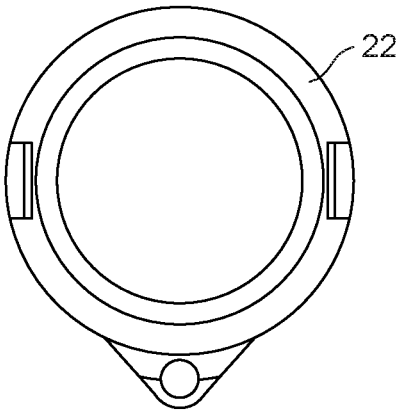
FIG. 15 is a top view of the collar.
Figure 16:
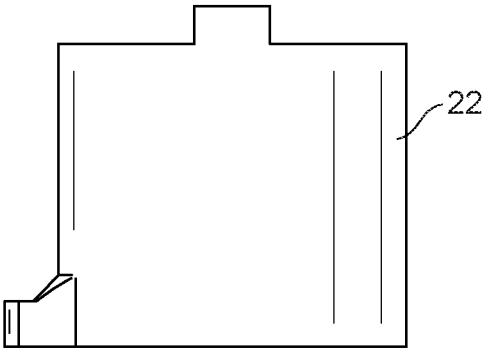
FIG. 16 is a view like FIG. 13 rotated 90 degrees.

The following is a description of elements shown in the figures: 33 is the gap between the collar 22 and the projection 30*a* (the taper in projection 30*a* may be taller than shown in FIG. 1 to provide more stability), the gap is sized to receive pole segment 18; 34 is the base of the upper portion 14; 35 is an aperture (FIGS. 2 and 12) in portion 14 and sized to receive projection/key 80; 36 is a radial and orthogonally extending ledge which is offset from the central axis 8; 38 is a connector with wires 40 to be connected to a power plug, not shown; 42 (FIG. 8) are apertures for receiving electrical contacts 44 (FIGS. 8 and 12); 50 is a projection extending from lower section 16. It has a tapered or flared section 52 at its proximal end to frictional engage diameter 30*a*; 54 is a base of the lower portion 16; 56 is a radial and orthogonally extending ledge; 58 is a connector projection sized to mate and engage with connector 38; 60 is a collar extending from based 56, coaxially aligned with projection 50 and defining a recess 66 (FIG. 7); 70 is a recess area (FIG. 12) in upper part 14 which is sized to receive connector 58 from the lower part; 80 is a key projection in projection 50 of lower part 16. 82 is a keyway slot in aperture 66 (FIG. 7) which receives key 80 to insure the alignment of connectors 38 and 58 when upper and lower parts are brought together. Keyway 82 also shown is FIG. 12, preferably includes angled portions 82*a* on either side of the keyway and a concentric section 83 which is sized to receive projection 50. The concentric section is interrupted by the keyway 82 and has a curved edge instead of a sharp corner at the keyway slot. This curved edge assists in urging a misaligned projection 80 into the slot by urging it to align into the center of the slot.

There is disclosed a central pole/staff which is composed of at least two parts 18, 20, one of which is received partially within the other to create, via a connector 12, a contiguous pole along a central axis 8. The pole may be made of two segments, a first 18 and second 20 segment, each segment being connected to a two-part joint/connector 12 having first/upper 14 and second/lower 16 portions respectively.

The two portions fit into each other and fit into the pole segments. The portions form an intermediary joint between pole segments.

The first portion has a central aperture 35 on its lower end and a tubular projection 30 (which may be circular, noncircular, or keyed) on the upper end sized to be received within the first pole segment. The second portion 16 has an upper central projection 50 sized to be received within the first portion aperture 35. The second portion also has a lower aperture sized to receive the second pole segment therein.

The first portion 14 includes a first ledge 36 extending generally orthogonally away from the segments and the axis 8. The first ledge includes a first connector part 38 extending orthogonally therefrom.

The second portion 16 includes a second ledge 56 extending generally orthogonally away from the segments and the axis 8. The second ledge includes a second connector part 58 extending therefrom. Said first and second connector parts 38/58 aligned to electrically engage when said first and second portions are engaged. In an alternate embodiment, the electrical connectors are omitted and a separate power line is provided.

In some embodiments, the first connector part includes a first block 38, having a plurality of terminals 42 and the second connector part 58 includes a recess 70, 44 and terminals for receiving and electrically connecting to the block. In this embodiment, the connector 38 is a removable and replaceable electrical receptacle friction fit into flange 35 which is part of a plate which extends from collar 22. Block 38 is preferably a female electrical connector. In North America that is a twin flat blade receptacle for receiving a standard power plug on its upper face and a pair of prongs on its lower face, though these could be reversed. Block 38 is retained in flange 35 by a notch therein sized to be just smaller than the width of block 38 thereby providing a frictional fit.

Both connector blocks 38 and 58 are removable and retained by the same mechanism, preferably a friction fit. This allows the use of standard connector blocks that do not need to be molded into the remaining structures.

Figure 3:
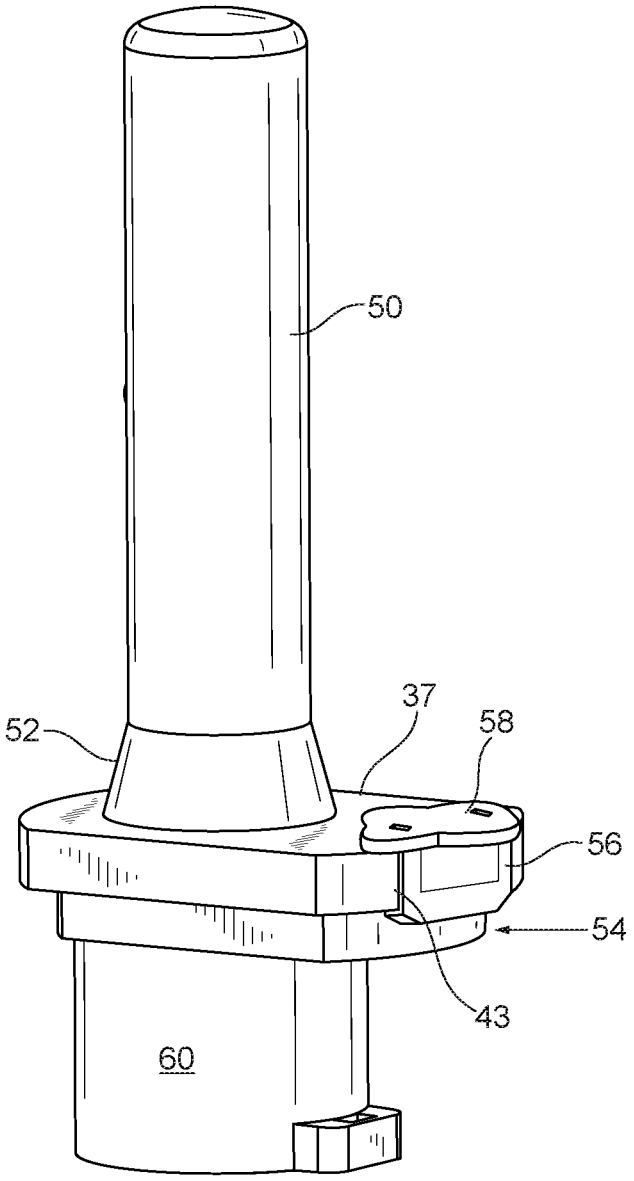
FIG. 3 is a side perspective view of the lower/second part of the connector.
Figure 4:
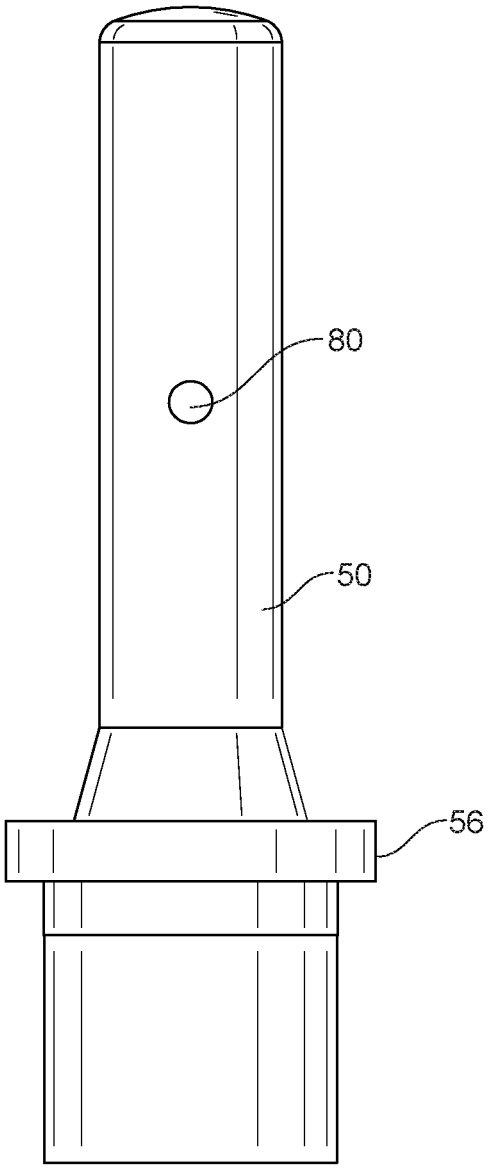
FIG. 4 is a view like FIG. 3 except the rear plan.
Figure 5:
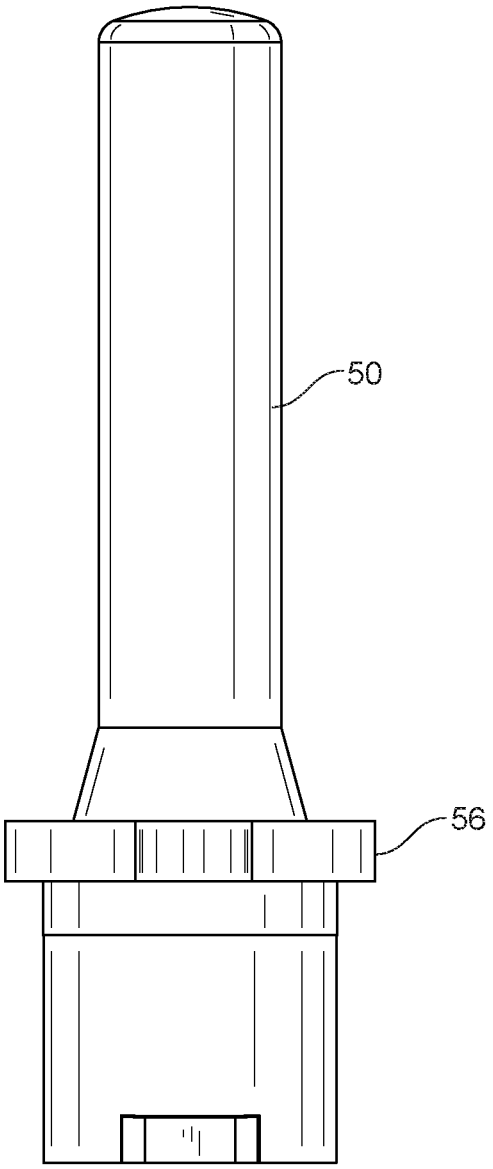
FIG. 5 is a view like FIG. 3 except the front plan.
Figure 6:
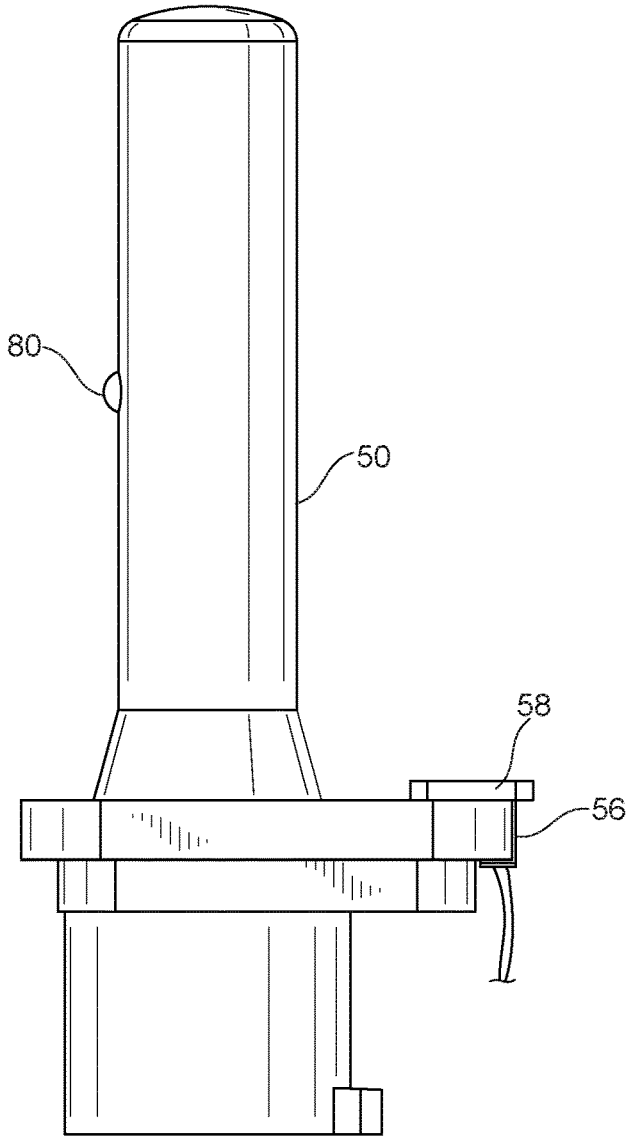
FIG. 6 is a view like FIG. 4 except the side plan.
Figure 8:
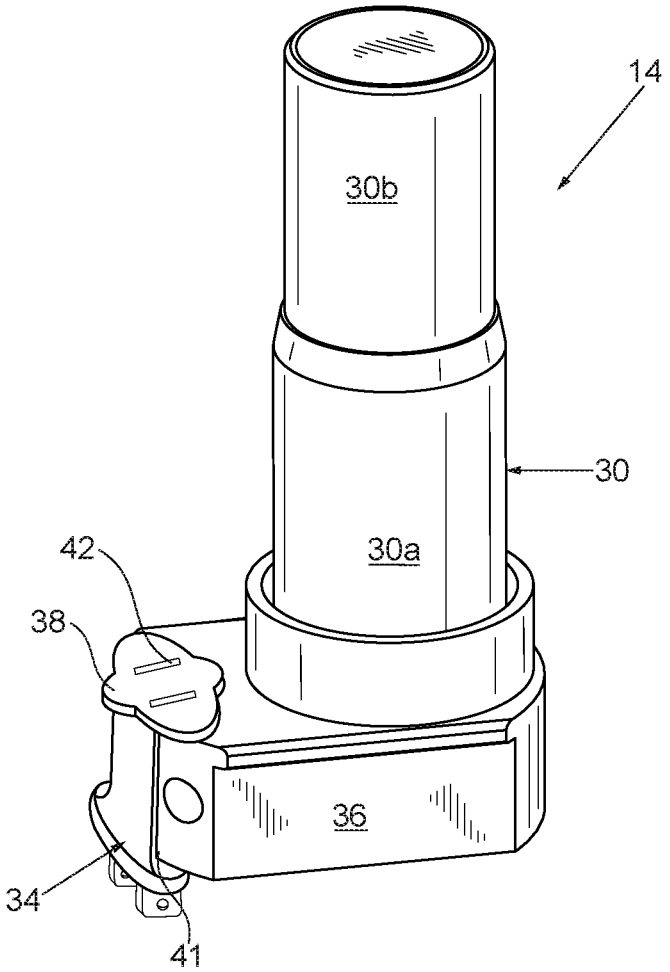
FIG. 8 is a perspective view of the upper/first portion of the connector.
Figure 9:
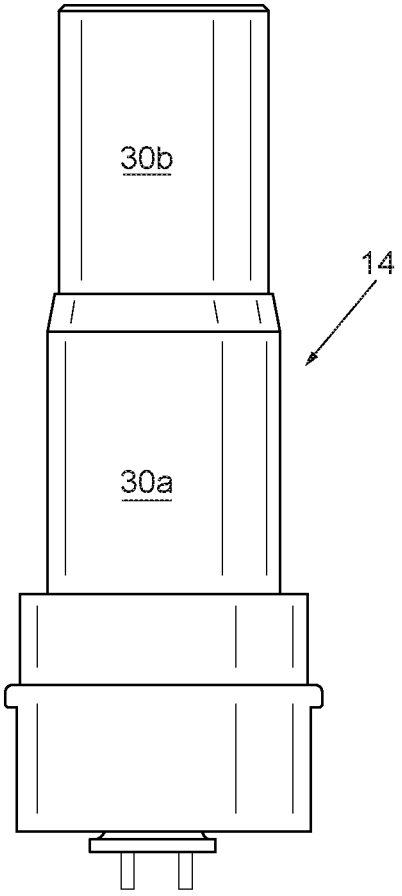
FIG. 9 is a rear plan view of FIG. 8.
Figure 10:
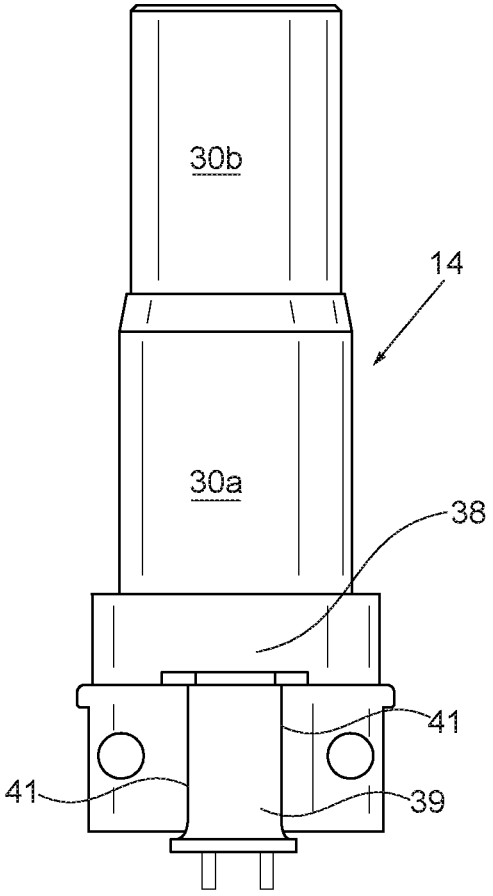
FIG. 10 is a front plan view of FIG. 9.
Figure 11:
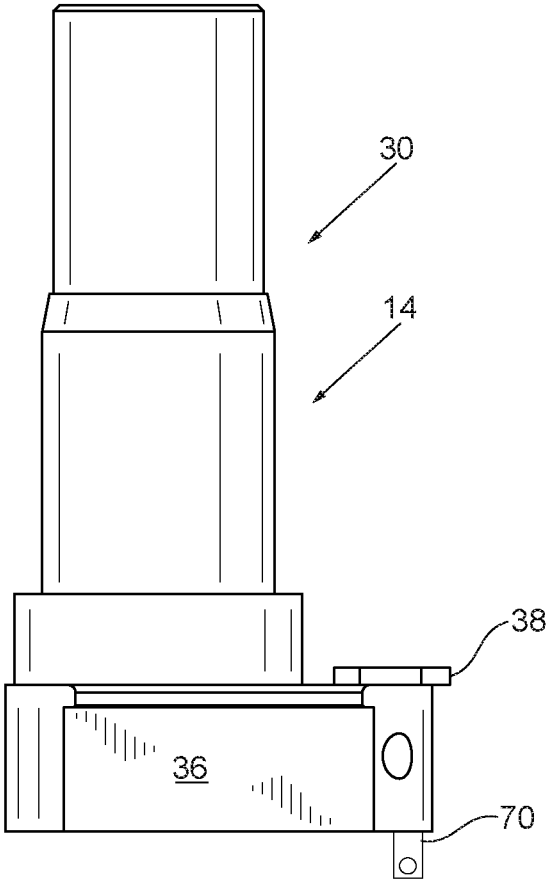
FIG. 11 is a side plan view of FIG. 10

In FIG. 3 and FIG. 8, there is a slot in plate 35, 37 which is bounded by parallel opposed arms 43, 41 which define a slot therebetween. The slot width is sized to be equal to, or slightly smaller than the width of the connector 35, 38. In the preferred embodiment, the arms are able to flex slightly so that the connector can be accommodated for insertion and removal. If the slot is equal to or slightly larger than the width of the connector, adhesive can be used. The depth of the slot is at least a portion of depth of the connector. In the preferred embodiment it is half or more. It can be more than the depth of the connector. In that case, the distal ends of the slot may include inward protrusions which capture the connector and prevent it from sliding out. The connector and gap sidewalls may also include sliding grooves or lands/recesses to guide the insertion and maintain the connector's orientation on the flange.

Figure 17:
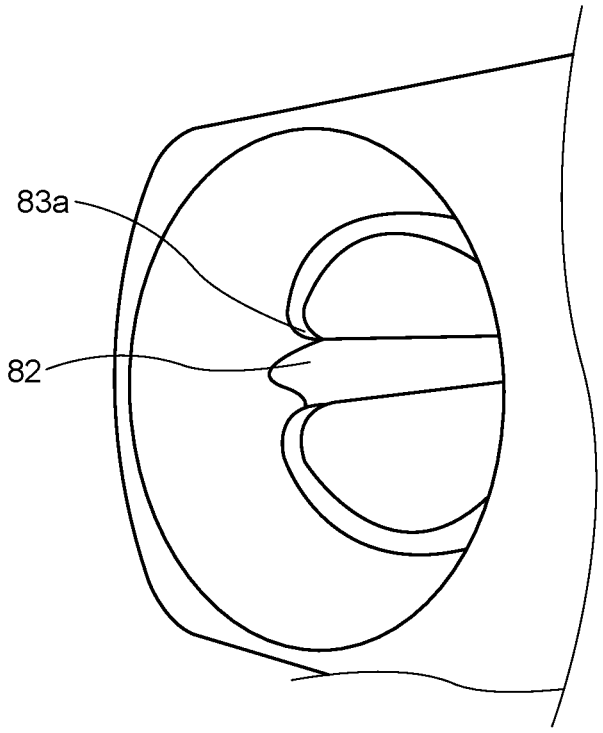
FIG. 17 is a perspective view of a portion of FIG. 12.

In some embodiments the aperture 66 on said first portion includes a guide keyway slot 82 and the projection 80 on said second portion includes a key pin, so that the slot and pin maintain alignment of the connecting blocks when brought together. This is an aligner which maintains the portion in rotational alignment (i.e. to prevent rotation and to minimize the torque on the electrical connectors) when said portions are brought together so that said connectors align and engage. As mentioned, the upper portion of the keyway 82 may have a funnel shaped curved leading edges on either side of the sloped opening to create a trough shaped opening 83*a* which allows the projection 80 to be urged along the funnel shaped curved slanted sidewalls on both sides of the slot opening 80 at the open end of the projection 30. See FIG. 17. The slot 82 which has a width sufficient to allow the entry of projection 80 also includes a front end opening with a pair of curved guide edges 82*a* which have an upper opening wider than the slot and converge to a width equal to the slot width. These edges 82 follow two curves simultaneously a) a downward curved slope to mate with the slot and b) a circular curve which mates with the inner curvature of aperture 35.

In some embodiments, the aperture on the first portion includes a tapered section 30*c* and wherein the projection on said second portion includes an expanded diameter 52 section at its proximal end, said expanded diameter section and said tapered section being sized to mate with each other.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A central pole connector for electrically and mechanically joining an ornamental lighting pole of at least first and second segments, to create a contiguous pole along a central axis, comprising:

a connector having first and second parts, each part having upper and lower ends;

said first part having a first central aperture on one end and a tubular projection at its other end, said projection being sized to be received within the first pole segment;

said second part has an upper central projection sized to be received within the first part aperture;

said second part including an aperture sized to receive at least a portion of the second pole segment;

said first part includes a first ledge extending generally orthogonally away from the axis; said first ledge including a first slot including a pair of spaced apart arms extending therefrom;

said second part including a second ledge extending generally orthogonally away from said axis; said second ledge including a second slot including a pair of spaced apart arms extending therefrom;

an electrical connector formed in two parts, one electrical connector part sized to be received within said slot of the first and the other electrical connector part sized to be received within said slot of the second part, said electrical connector being aligned to electrically engage when said first and second parts are engaged.

2. The connector of claim 1 wherein said first and second slots are of a predetermined width and said electrical connector includes a width greater than said slot and wherein said arms are resilient so that when said connector is inserted into said slot, said connector is snugly received therein.

3. The connector of claim 1 wherein said first and second slots are of a predetermined width and said electrical connector includes a width equal to or less than said first and second slots and wherein said arms are resilient so that when said connector is inserted into said first and second slots, said connector fits therein.

4. The connector of claim 3 further including adhesive in said either of said first and second slots to maintain said connector in therein.

5. The connector of claim 1 wherein the arm further including inwardly projecting lands which thereby constrict the gap at its opening and wherein the arms are resilient so that when the connector is placed within the gap, it is maintained therein by the lands.

6. A method of providing an electrical power connection to coaxially aligned first and second concentric tubes of an ornamental lighting pole comprising:

sizing the first tube, having an open end, to receive within at least part of the second tube;

providing flanges on both first and second tubes;

providing a slot in each flange sized to receive an electrical connector;

sizing said slot to be just smaller than a cross section of the electrical connector;

aligning the slots to be collinear; and inserting the electrical connector into the slot.

7. A central pole connector for electrically and mechanically joining an ornamental lighting pole of at least first and second segments, to create a contiguous pole along a central axis, comprising:

a connector having first and second parts interposed between ornamental lighting pole segments, each part having upper and lower ends;

said first part having a first central aperture in one of the upper or lower end one end and a tubular projection at the other of the upper or lower end, said projection being sized to be received within the first pole segment;

said second part has an upper central projection sized to be received within the first part aperture;

said second part including an aperture sized to receive at least a portion of the second pole segment;

an electrical connector formed in two parts, one electrical connector part fixed to said first part and the other electrical connector part fixed to said second part, said electrical connector being aligned to electrically engage when said first and second parts are brought together.

* * * * *